United States Patent [19]

Grigsby

[11] Patent Number: 5,069,338

[45] Date of Patent: Dec. 3, 1991

[54] SUPPORT PAD AND A PALLET WITH SOCKETS FOR A WOOD REINFORCED CORRUGATED PAPERBOARD SHIPPING CONTAINER

[75] Inventor: John M. Grigsby, Marietta, Ga.

[73] Assignee: North American Container Corporation, Mableton, Ga.

[21] Appl. No.: 403,747

[22] Filed: Sep. 6, 1989

[51] Int. Cl.[5] ..... B65D 85/68

[52] U.S. Cl. ..... 206/319; 206/320; 206/335; 206/386; 206/586

[58] Field of Search ..... 206/319, 320, 335, 386, 206/453, 586, 595, 599, 600; 220/651, 652; 229/919

[56] References Cited

U.S. PATENT DOCUMENTS

| | | | |
|---|---|---|---|
| 4,171,741 | 10/1979 | Fish | 206/386 |
| 4,610,355 | 9/1986 | Maurer | 206/599 |
| 4,792,041 | 12/1988 | Grigsby . | |
| 4,836,411 | 6/1989 | Jones | 220/651 |
| 4,938,350 | 7/1990 | Grigsby | 206/319 |

FOREIGN PATENT DOCUMENTS

| | | | |
|---|---|---|---|
| 146436 | 6/1985 | European Pat. Off. | 206/386 |
| 2457810 | 1/1981 | France | 206/600 |
| 2551726 | 3/1985 | France | 206/386 |
| 2583383 | 12/1986 | France | 206/386 |
| 2585333 | 1/1987 | France | 206/386 |
| 2594800 | 8/1987 | France | 206/386 |

*Primary Examiner*—David T. Fidei

*Attorney, Agent, or Firm*—Jones, Askew & Lunsford

[57] ABSTRACT

A wood cleated corrugated container having a load bearing, protective insert of corrugated board with a pair of rigid support members supported by a plurality of coplanar support points along a plane defining a boundary of, or dividing, the container. The corrugated container includes a wood pallet base having sockets which receive the lower ends of the vertical cleats to resist dislodgement of the cleats from the pallet during handling, shipment and storage.

8 Claims, 4 Drawing Sheets

SUPPORT PAD AND A PALLET WITH SOCKETS FOR A WOOD REINFORCED CORRUGATED PAPERBOARD SHIPPING CONTAINER

TECHNICAL FIELD

The present invention relates to wood reinforced corrugated containers. More particularly, the present invention relates to a support pad of semi-rigid material for protecting contents of corrugated containers from damage, and relates to a pallet having a plurality of sockets, each receiving a vertical cleat attached to the corrugated container, for resisting separation of the cleat from the pallet and reducing the incidence of cleat failure which causes damage to both the container and its contents.

BACKGROUND OF THE PRESENT INVENTION

Heavy durable goods such as lawn and garden tractors, lawn mowers, boat motors, and engines, among other goods, present problems for packaging. Such machinery is generally difficult to pack, handle and store. Conventional corrugated containers have long been recognized as unsuited for packing such heavy, bulky goods. Wooden containers provide structural support and protection for the contained goods, but the weight, size and handling problems of such wooden containers limit their use. As a result, wood reinforced (cleated) corrugated paperboard boxes with mating wood pallet bases and wood top frames have been developed. Such an assembly is generally known as a pack.

The conventional wood cleated, corrugated box provides at least one interior wall with one or more wood reinforcement cleats vertically aligned. The wood cleats attach to the corrugated box in a conventional manner, such as with glue, staples or preferably a combination thereof. The corrugated paperboard body gives the container definition and maintains the position of the vertical wood cleats. The corrugated paperboard preferably is of sufficient strength to act as bracing to keep the wood vertical cleats erect. If the board is too light, it may rip during handling and shipment of stacked containers. This allows the stack to collapse in a sideways or trapezoidal manner. In some embodiments, special reinforcing filaments, or tear tapes are manufactured into the corrugated paperboard in a girthwise direction to assist preventing such tearing and trapezoidal collapse of the packs.

The wood pallet forms a base which attaches to the paperboard box and supports the product packed therein. The top frame cooperates with the flaps of the corrugated box to close the container and provide a surface upon which another container may be stacked.

Durable goods are typically stacked in packs up to six units high for efficient utilization of warehouse space. The wood cleated corrugated paperboard box with a matching wood pallet base and wood top frame commonly achieves the necessary stacking or top load strength for shipping, handling, and storage of such heavy, durable goods. In particular, the wood vertical cleats attached to the side walls of the corrugated box have greater compression strength than the corrugated paperboard alone. Wood does not experience loss of strength during conditions of a high heat and humidity as does standard corrugated paperboard. Products packaged using wood cleated, corrugated paperboard boxes can typically be stacked higher with greater degree of safety than corrugated paperboard boxes.

The goods typically contained in such reinforced containers are heavy. For instance, garden tractors weighing up to 800 pounds or more are typically enclosed in such containers. Stacking requires that the top of the package be supported so that the upper units do not cause the lower units to collapse. The top support generally is provided by the wooden top frame positioned on top of the vertical wood cleats inside the corrugated box.

Conventional packaging of heavy equipment in a typical wood cleated pack first fastens the equipment to the pallet. The wood reinforced corrugated paperboard box is then placed over the equipment and slid down over the pallet. The corrugated paperboard box is stapled to the wood runners of the pallet in a conventional manner by a compressed air-driven staple gun. The top frame inserts into the upper portion of the corrugated body. The upper ends of the wood cleats receive and support the top frame. The top flaps of the box fold over the top frame. Staples and glue security attach the flaps to the top frame. Steel or plastic banding is often provided to gird the completed pack.

For a flange-style pack, the paperboard box is first positioned upside down and the pallet is inserted into the box to rest on the lower ends of the cleats. The flanges extending from the box fold over the bottom surfaces of the pallet. The flanges are stapled to the pallet to attach the pallet and the box together. The pack is then positioned right side up for receiving the product and the top frame.

An alternate method joins the corrugated box to the pallet with attaching strips. Such strips are glued and stapled to the bottom perimeter of the corrugated box side walls. Nails or narrow crown long-legged staples are driven through the box walls, the strips, and into the boards of the pallet. Such a method provides adequate joining of the box to the pallet to allow clamp truck handling while minimizing the risk of separation of the box from the pallet. This style further allows the packers to roll the tractor onto the base instead of hoisting and dropping the tractor into the box as is done with the flange-style pack described above.

While wood reinforced shipping containers have proven adequately effective for packaging heavy equipment, several problem exist. Among these are problems arising from use of conventional package handling equipment, such as fork lifts and clamp trucks. Generally, the use of fork lifts require that the shipping container include an external skid board below the container to provide clearance for the fork blades. This requires extra parts for the pallet, and increases the height of the container in which the product is stored. Such additional height is compounded in a high stack of containers and may result in failing to fully utilize the stackable dimensions of the truck or rail car. This results in fewer units in the load and a higher freight cost for shipping the manufactured product.

Clamp trucks use parallel vertical platens to handle packs. The platens squeeze against the sides of the pack. Clamp truck handling however encounters problems when the platens are not of sufficient size to engage the full depth of the package. The operator of the truck often attempts to maneuver the clamped platens toward the center-most area of the box walls. This produces an undesirable inwardly directed force on the box side walls and the wood vertical cleats. The corrugated paperboard may rip along the bottom where it attaches to the wood pallet. A worse consequence is failure of the wood vertical cleats which provide the stacking strength of the pack. The cleats may be knocked loose from the corrugated side walls, broken, or forced off the pallet surface on which they sit. Failure of the wood vertical cleats compromises the top load stacking strength. Damage to the container and the product may result. Use of a container with an undetected cleat failure may lead to the collapse of a five or six high stack of 800 pound tractors. Prevention of such side wall failure is important when handling and storing heavy equipment packed in such containers. On some known pallets, a cross member providing the pallet with structural support also supports the lower end of a box cleat. The cross member is positioned against a side of the cleat and resists dislodgment of the cleat by a force on the cleat in the direction of the cross member. This side support however does not prevent the cleat from splitting near its notched lower end. It also does not provide resistance to a transverse force such as that experienced when the clamp truck operator picks up the pack with the platters on the "wrong" sides.

As discussed, heavy equipment packed in wood reinforced containers often is handled in a variety of circumstances at the manufacturing plant, in transit, and at the retail sales store. Each facility may have different package handling equipment. For handling convenience, the package must provide sufficient bottom strength and fork entry clearance for fork truck handling. The pack must also have adequate side-to-side and end-to-end strength to allow clamp truck handling. Securing the wood cleated corrugated box to the pallet must provide sufficient strength so that when clamp trucks are used, the weight of the equipment on the pallet will not cause the pallet to separate from the box.

Generally, it is easier for a lift operator to stack and unstack packs in a warehouse with a clamp truck. This is because the operator can better see the position of the large platens against the side walls of a pack instead of attempting to place the blades of the fork truck in the relatively narrow openings of the pallet of a forkliftable pack. This is especially true when the operator is attempting to unstack packs at the upper end of a stack that may reach twenty (20) feet or more in height. Also, the difficulty in positioning one pack unit on top of another in a warehouse requires that the bearing surface of the top of the pack have increased capacity. Then, inexact placement of an upper pack in warehouse stacking or in stack shipment will not cause the upper packs to collapse the top of a lower pack and damage the contents. Shifting during transit, or improper stacking without supporting the tops of the lower packs, may result in one or more containers being crushed and stacks falling over, with resultant damage to the tractors and possible injury to personnel.

To provide top strength, typical cleated corrugated boxes include the wooden frame top which sits on the upper ends of the wood cleats. Special mating notches and grooves cut in the upper end of the cleats and in the ends of the top frame members cooperate to prevent the top frame from shifting off of the vertical cleats during handling and shipping of the pack. The top frame, locked onto the wood cleats, distributes the load of the upper packs onto a lower pack, provides protection to the vulnerable hood of a tractor (or to the contained item) and provides additional clamp truck strength against the side-to-side or end-to-end pressure exerted by the platens of a clamp truck.

These top wooden frames, however, have drawbacks and may themselves damage the tractor in the container. One problem with these top frames is that the size and weight is such that it is difficult for personnel on the assembly lines to lift the frame over the box side walls and position it on the vertical post. Often, these frames, due to the pack dimensions, contain up to 15 board feet of lumber, or more, and have a weight of 30 pounds or more. It is awkward for one person to handle such frames. The combination of the frame weight and size may cause the packer to have difficulties handling the frame and positioning it in the container. Accordingly, two or more persons are often required for packing a tractor in such a container.

An additional problem has been that the boards in the top frame occasionally break. Such breakage is sometimes caused by the force exerted by upper packs in a stack during transit or warehousing. In other circumstances, heavy containers fall through the top of the pack or break through the frame boards. Sometimes, the boards making up the frame are defective and unable to support the load for which the frame is designed. A knot in the wood particularly weakens a board. Broken boards are forced downward and scratch or dent the hood or other parts of the tractor the top frame was designed to protect.

It is also important that such wood reinforced packs be readily and easily handled for shipment from the box manufacturer to the user. The corrugated box must be fully collapsible for shipment. A box which is not collapsible incurs significant additional cost, including use of excessive space in both transit and warehousing and freight costs would be higher. For example, a typical 48 foot road van holds 48 set-up garden tractor boxes, whereas it will hold approximately 250 sets of knocked-down garden tractor packs.

Accordingly, there is a need in the container industry for a top support for wood cleated containers which overcomes the problems associated with the use of top wood frames for containers. There is also a need for a pallet which overcomes the problems arising from the use of a wood cleated corrugated body attached to a pallet.

BRIEF DESCRIPTION OF THE PRESENT INVENTION

The present invention solves the problems with the wood frame top used in wood cleated corrugated packs. The pallet of the present invention further overcomes other problems from use of wood cleated corrugated packs for storing and shipping heavy equipment.

The present invention provides a load bearing, protective support pad for wood cleated corrugated containers. Generally described, the present invention provides a sheet of semi-rigid material which inserts into the container and is supported by a plurality of coplanar support points along a plane defining a boundary of, or dividing, the container. Two spaced-apart, rigid members attach to the sheet of material. The members are disposed in the pack between the support points and the sheet of material.

More particularly described, the present invention provides a wood cleated corrugated paperboard box which attaches to a wood pallet. The top frame is a pad comprising the sheet of semi-rigid material with support members. The pad inserts into the top of the container and is supported on the upper ends of the vertical cleats attached to the paperboard body.

The pad supports and distributes the top load in stacking during warehousing or transit. It protects the contents of the pack, such as the hood of the tractor, from damage and paint abrasion. The support pad according to the present invention provides clamp truck platen resistance. It is lighter in weight than standard wood top frames. Generally, it is equal or less in cost than standard wood top frames and is easily knocked down for storage, handling, and transit. The support pad positively interlocks with the wood vertical cleats of the container box.

Also generally described, the pallet of the present invention provides sockets, each of which receive a lower end of the vertical cleats on the wood cleated paperboard box. The sockets enable the vertical cleats to resist dislodgement from the pallet under clamp truck pressure. Further, the pallet provides entry clearance for fork truck handling.

More particularly described, the sockets are defined by the stair-step junction of an outside runner, a cross member and a notched chock board on the pallet. The cross member is positioned on the outside runner to form a gap between the outside edge of the runner and the end of the cross member. The notch in the chock board exposes a portion of the upper surface of the cross member to define another gap between the end of the cross member and an edge of the notch. The notched end of the corner vertical is received within the socket.

Accordingly, it is an object of the present invention to provide a pad that supports and distributes the top load weight experienced while the pack is placed in a stack for transit, handling, or warehousing.

It is another object of the present invention to provide a pad which protects the contents of the pack.

It is another object of the present invention to provide a pad which inserts into a pack to protect the contents of the pack from damage should the pack be ruptured.

It is another object of the present invention to provide a pad in a pack that prevents scratches or paint abrasion on the contents of the pack arising from incidental contact between the contents and the pack member.

It is another object of the present invention to provide a pad for the pack frame, which resists container collapse from clamp truck platen pressure.

It is object of the present invention to provide a pad for a pack frame, which is lighter in weight than a similarly sized wooden frame.

It is object of the present invention to provide a pad which interlocks with the upper end of the vertical cleats of a corrugated box.

It is object of the present invention to provide a pallet which prevents the pack vertical cleats from being forced off the pallet by clamp truck platen pressure.

It is another object of the present invention to provide a pallet which receives the bottom of the vertical cleats to resist breakage of the cleat near its lower notched end.

Still other objects, features and advantages will become apparent upon reading the following detailed description in conjunction with the drawings and the appended claims.

DETAILED DESCRIPTION OF THE PREFERRED EMBODIMENT

Figure 1:
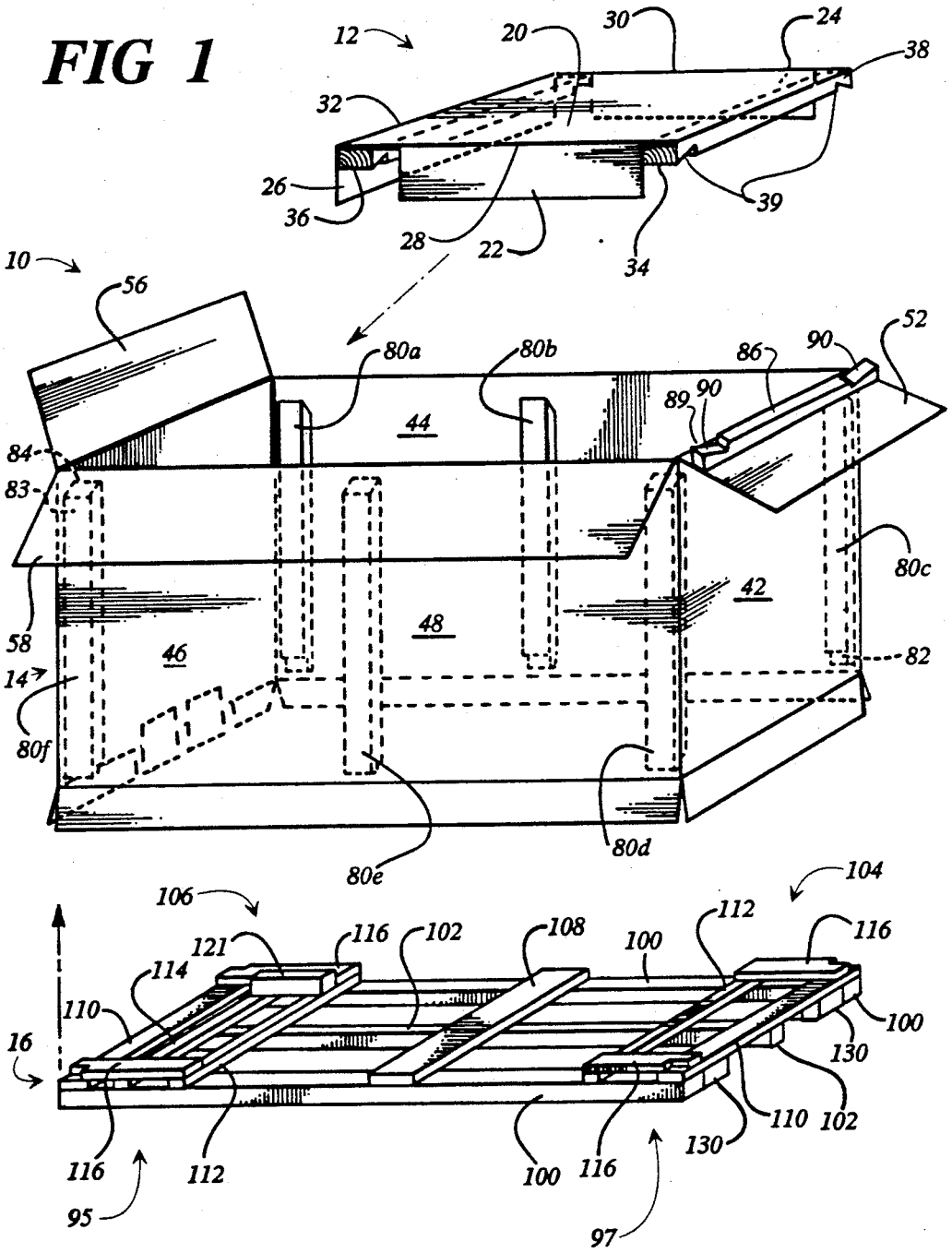
FIG. 1 is a perspective view of a wood cleated corrugated pack having a disclosed embodiment of a protective support pad and a disclosed embodiment of the socket pallet.

Referring now in more detail to the drawings, in which like numerals indicate like parts throughout the several views, FIG. 1 is a perspective view of a corrugated pack 10 which includes a top support pad 12, a body 14 for a wood cleated corrugated box and a pallet 16 having sockets to receive the bottom of the wood vertical cleats attached to the corrugated body 14.

The top support pad 12, according to the present invention, is a protective insert which includes a planar sheet 20 of material such as corrugated paperboard. The sheet 20 includes a pair of side flanges 22 and 24 and an end flange 26 foldably connected to the sheet along three score lines 28, 30, and 32, respectively. A pair of rigid cross support members 34 and 36 attach in a conventional manner such as with glue to a bottom surface of the sheet 20. Preferably, the support members 34 and 36 are positioned perpendicular to the direction of corrugation of the sheet 20. One support member 34 is attached adjacent a free edge 38 of the sheet 20. The other support member 36 is attached adjacent the fold line 32. The longitudinal ends of both support members 34 and 36 include a notch 39.

Figure 2:
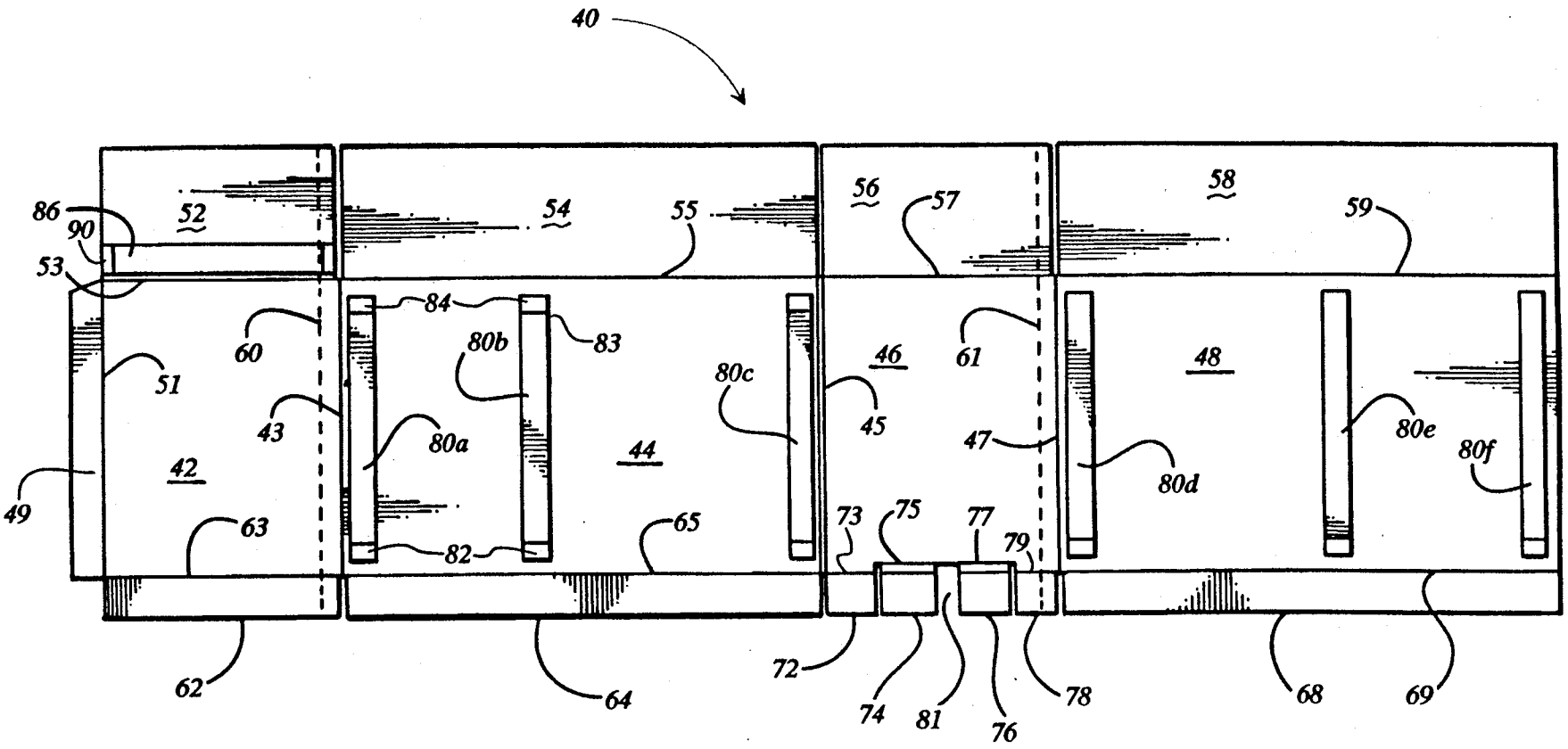
FIG. 2 is a top plan view of a corrugated paperboard blank for forming the body portion of the pack shown in FIG. 1.

The body 14 of the pack 10 forms from a blank 40 of corrugated paperboard material, as illustrated in FIG. 2. With reference to both FIGS. 1 and 2, the blank 40 includes four main panels 42, 44, 46, and 48 foldably connected along three score lines 43, 45, and 47. The four main panels 42, 44, 46, and 48 form the four walls of the corrugated body 14. A manufacturer's joint 49 is foldably connected to the main panel 42 along a score line 51. The manufacturers joint, common in the industry, allows the ends of the blank 40 to be joined together with glue and staples to form a completed body 14. A series of four top flaps 52, 54, 56, and 58 are foldably connected to the main panels 42, 44, 46, and 48, respectively, along score lines 53, 55, 57, and 59. It will be noted that additional folding scores are provided on the blank 40. A first additional folding score 60 is provided on the main panel 42 and the top flap 52. A second additional folding score 61 is provided on the main panel 46 and the top flap 56. The additional folding scores 60 and 61 are parallel to and spaced-apart from the scores 43 and 47, respectively. The function of these additional scores is described in detail below.

A series of bottom flanges 62, 64, and 68 are foldably connected to the main panels 42, 44, and 48, respectively, along score lines 63, 65, and 69. The illustrated embodiment of the corrugated blank 40 also includes four flanges 72, 74, 76, and 78 foldably connected to the main panel 46 along score lines 73, 75, 77, and 79, respectively. A cutout 81 is defined between the flanges 74 and 76; smaller slots are formed between the flanges 72 and 74 and the flanges 76 and 78. The score lines 75 and 77 are laterally displaced from the edge of the blank more than are the score lines 73 and 79, for a purpose to be described below.

The main panels 44 and 48 of the blank 40 are each provided with a plurality of vertical reinforcements cleats 80. The main panel 44 is provided with vertical cleats 80*a*, 80*b*, and 80*c*. The main panel 48 is provided with vertical reinforcement cleats 80*d*, 80*e*, and 80*f*. The cleats 80 attach in a conventional manner, such as with glue, staples or a combination thereof, to the inner surface of the main panels 44 and 48. The vertical reinforcement cleats 80 are preferably made of a dense wood and extend substantially the height of the respective main panels 44 and 48. The cleats 80 are positioned on the main panels 44 and 48 such that there is a space between the top of the cleat 80 and the score lines 55 and 59. Similarly, the bottom of the cleats 80 are spaced away from the score lines 65 and 69. The bottom portion of each vertical reinforcement cleat 80 is notched; the notch being generally indicated at 82. The uppermost portion 83 of each vertical reinforcement cleat 80, as best illustrated in FIG. 1, defines a bevelled surface 84. The outer portion of the cleat 80 has a greater height than the innermost portion of the cleat 80 adjacent the corrugated panel 44 or 48 to which the cleat 80 is attached. The bevelled surface 84 is preferably angled at about 24 degrees, but this may vary from about five to about 30 degrees.

The top flap 52 includes a cross support member 86. The cross support member 86 is spaced away and parallel to the score line 53 so that the top flap 52 may fold at a right angle to the panel 42. The longitudinal ends of the cross support member 86 are notched, as generally indicated at 90 in FIG. 1. The bevel of the notch 90 matingly engages the bevel 84 in the vertical cleats 80*c* and 80*d* when the blank 40 is assembled into the corrugated body 14. A bevel angle too shallow does not permit the cleat 80 to adequately hold the mating cross support member 86. A large angle cuts deeply through the width of the cleat and the cross member, leaving them ineffectively joined and susceptible to splitting.

In an alternate embodiment, the paperboard blank 40 includes a pair of slits placed to prevent irregular tears in the paperboard. Tears contribute to the weakening of the body 14. One slit is made along the top flap score line 53 between the score lines 43 and 60. The second slit is made along the top flap score 57 between the scores 47 and 61. The slits relieve stress in the paperboard when the body 14 is knocked down flat for shipment when the corrugated body 40 folds over the vertical cleats 80*a* and 80*d*. The slits also prevent tears when the body 14 is squared open during the packing process.

The pallet 16 is illustrated in perspective view in FIG. 1 and in various plan views in FIGS. 3A, 3B, 3C, and 3D. The pallet 16 of the illustrated embodiment supports a typical four wheel garden tractor having a heavy engine mounted between a driver's seat and a pair of front wheels. The front end of the pallet supporting the engine and front wheels is generally designed 95; the back end is designated 97. The pallet 16 includes a pair of outside runners 100 and a middle runner 102. The runners 100 and 102 are connected together by a back wheel framing 104, a front wheel framing 106, and a middle cross member 108.

The back wheel framing 104 and the front wheel framing 106 each include an end cross member 110 and a parallel inner cross member 112. The front wheel framing 106 in the illustrated embodiment also includes an intermediate cross member 114 parallel to and positioned between the front wheel cross members 110 and 112. The cross members 110, 112, and 114 in each framing 104 and 106 are rigidly connected transverse to the longitudinal axis of the runners 100 and 102 in a conventional manner, such as with nails or staples. The cross members 112 and 114 in the framing 104 cooperate with the middle runner 102 to define a pair of front wheel wells 118 which receive the front wheels of the contained tractor. Typically, the front wheels of a garden tractor are further from the front edge than are the rear wheels from the back edge of the tractor. The cross members 110 and 112 in the back wheel framing 104 cooperate with the middle runner 102 to define a pair of back wheel wells 120 which receive the rear wheels of the contained tractor.

A pair of chock members 116 attach in a conventional manner in each framing 104 and 106 across the top surfaces of the cross members 110 and 112. In the illustrated embodiment, the longitudinal axis of the chock members 116 are parallel to the longitudinal axis of the outside runners 100. The outer edge of the chock member 116 aligns with the end of the cross member 112. A notch 124 is cut in the outside corner of each chock member 116. The chock members 116 are dimensioned in width to reach the sides of the tractor wheels and define the side perimeters for the wheel wells 118 and 120. The chock members 116 restrain the tires of the tractor and prevent side to side motion of the tractor about the pallet 16. In some cases, due to the physical shape of the tractor and the position of the cutter housing under it, an additional block 121 may be added inside of one of the chock members 116 to offset laterally the position of the tractor on the pallet 16. An alternate embodiment provides a single board parallel to the end cross member 110, instead of a pair of chock members 116. The longitudinal ends of the single board each include the notch 124 for the purposes disclosed below.

Figures 3A, 3B, 3C, 3D:
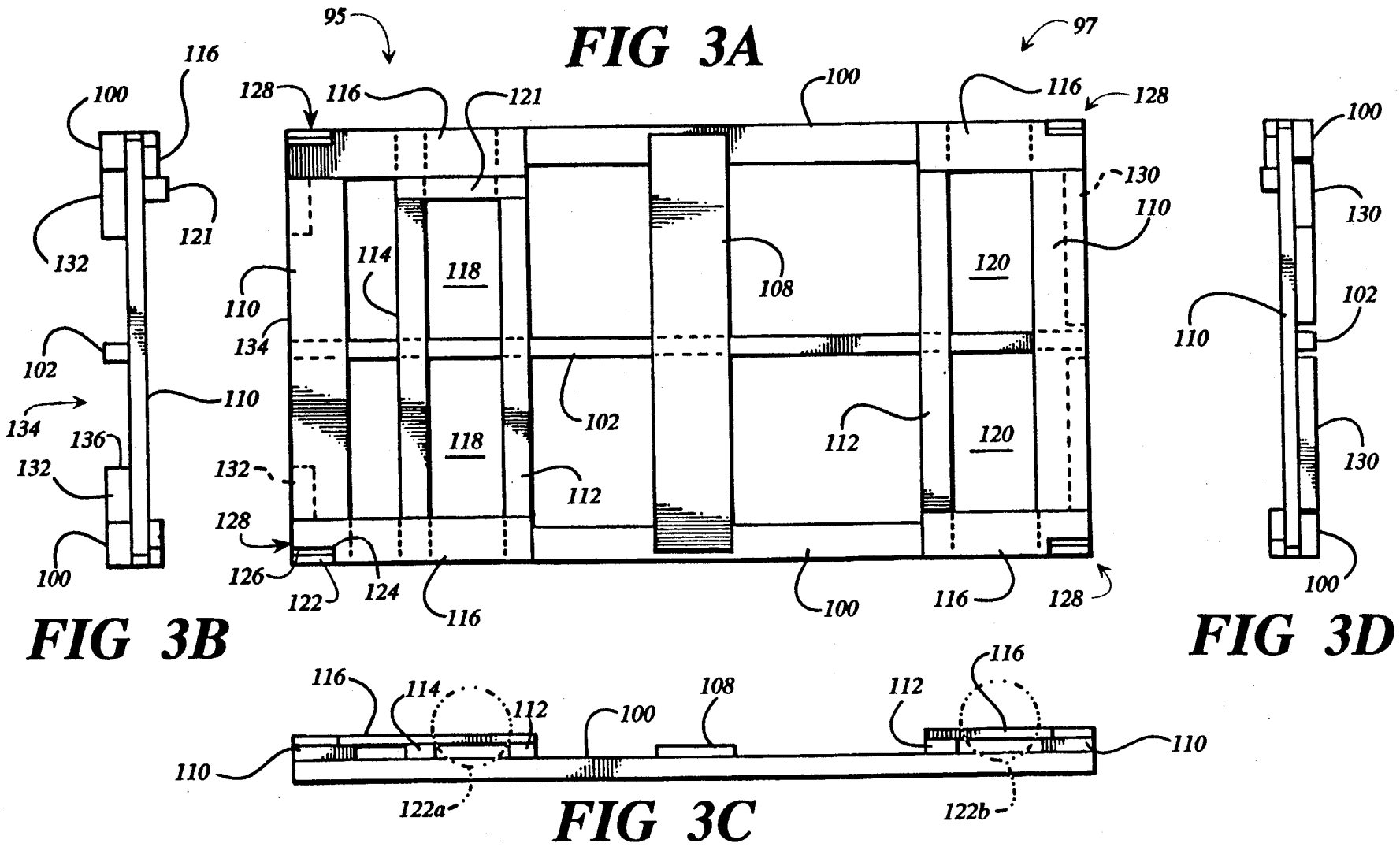
FIG. 3A is a top plan view of the disclosed embodiment of the pallet shown in FIG. 1.
FIG. 3B is an end view of the pallet shown in FIG. 3A.
FIG. 3C is a side view of the pallet shown in FIG. 3A.
FIG. 3D is a second end view of the pallet shown in FIG. 3A.

As illustrated in FIG. 3A, the cross member 110 does not extend the full distance between the outer edges of the runners 100, but rather leaves a gap 122 between the outer edge of the runner 100 and the end of the cross member 110. The notch 124 leaves a portion of the upper surface of the cross member 110 uncovered. A second gap 126 is thereby defined between the end of the cross member 110 and the side of the notch 124 in chock member 116. The cross member 110, the runner 100 and the chock member 116 cooperate to define a stair-step socket 128 which receives the lower end of a vertical cleat 80, as better illustrated in FIG. 4.

FIG. 3C is a side view of the pallet illustrated in FIG. 3A. The positioning of the cross members 112 and 114 may vary longitudinally depending on the size of the tire wheels to be received into the wheel wells 118 and 120. It is preferred that the bottom of a tractor wheel 122*a* and 122*b* received in the wheel wells 118 and 120, respectively, reach no lower than the bottom surface of the runners 100, as illustrated in phantom in FIG. 3C.

The lateral positioning of the wheels in the wells 118 permits the fork lift blades to extend under the pallet and between the front wheels 12*a* without damaging the tractor tires.

In that regard, the pallet 16 of the present invention is fork liftable from one end only. The pallet 16 includes a pair of bottom blocks at the longitudinal ends. Each pair of blocks are mounted below the cross member 110 between the runners 100 and middle runner 102. With reference to FIG. 3D, the back end 97 of the pallet includes a pair of blocks 130 mounted to the bottom of the cross member 110. Each of the blocks 130 are disposed between the runners 100 and 102. In the illustrated embodiment, a small cutout is left between the end of the block 130 and the runner 102. In an alternate embodiment, a longer block completely fills the space between the runners. The blocks 130 thereby prevent the operator of the fork lift from inserting the blades and handling the pack from the "light" end of the tractor and thus risk dropping the pack off the end of the blades.

As shown in the end view FIG. 3B, a second pair of blocks 132 mount to the underside of the board 110 at the front end 95 of the pallet 16. The blocks 132 generally are shorter in length than the blocks 130 and preferably each block 132 is as long as the width of the tire held in the wheel well 118. In the illustrated embodiment, one end of the block 132 positions adjacent the outside runner 100. A cutout 134 is defined between the second end 136 of the block 132 and the middle runner 102. The cutout 134 is sufficiently wide to accommodate a typical fork lift blade inserted under the cross member 110 and beside the tractor wheel 122*a*.

In an alternate embodiment, the blocks 132 are positioned between the runners 100 and 102 in line with respect to the lateral position of the tires in the wheel well 120. The blocks 132 guide the operator of a fork lift truck in positioning the fork lift blades by preventing the blades from entering the pallet 16 in line with the location of the tires. The blades enter under the pallet 16 through the cutouts 134 and extend between the tractor tires.

Figure 4:
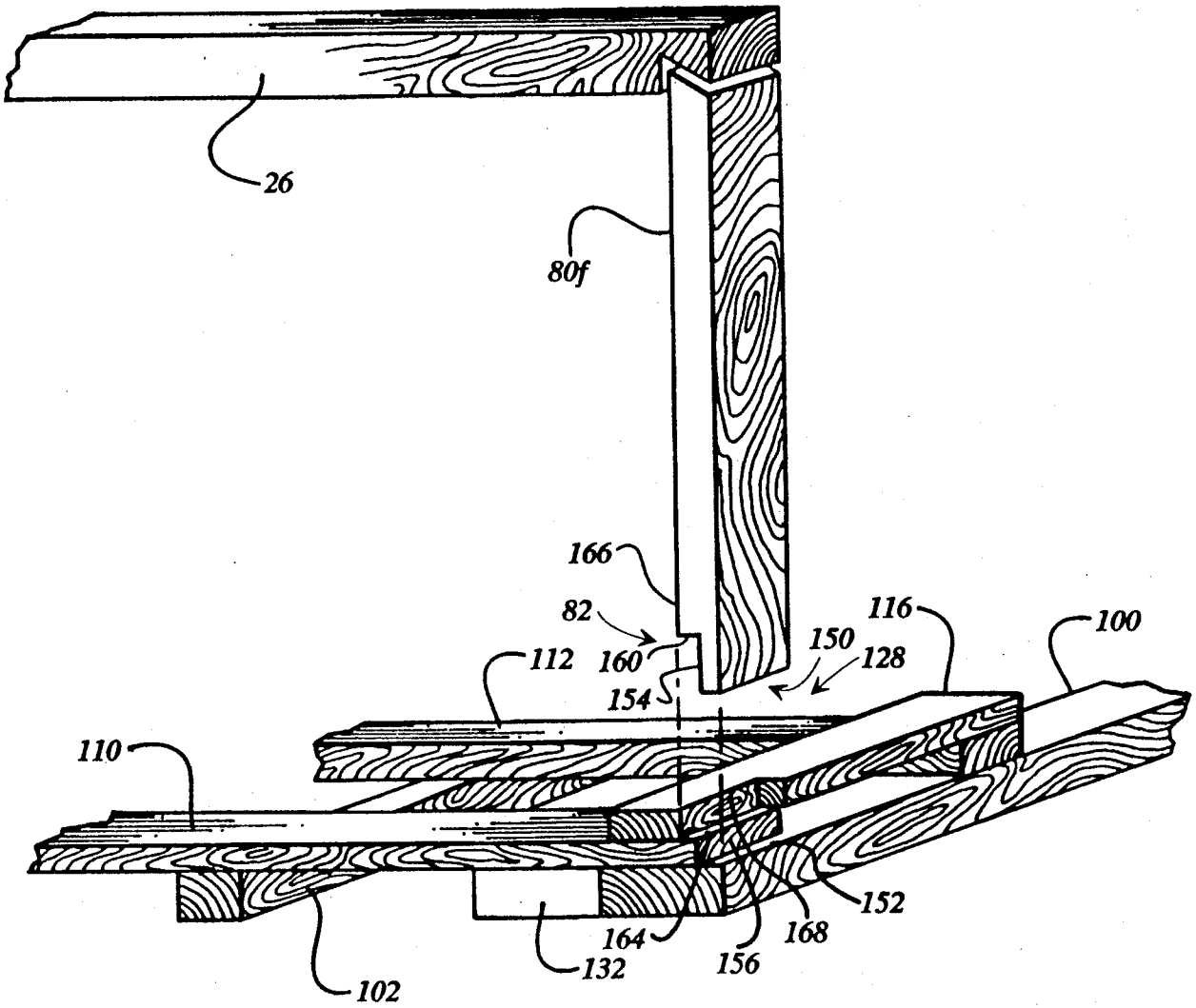
FIG. 4 is a perspective view of a corner socket on the pallet shown in FIG. 1, with a vertical cleat of the pack exploded from the socket.

FIG. 4 is a perspective view of a corner socket 128 on the pallet 16 shown in FIG. 1, with the container vertical cleat 80*f* exploded from the socket 128. A bottom edge 150 of the vertical cleat 80*f* rests on a top surface 152 of the runner 100. A vertical face 154 of the notch 82 rests against an end edge 156 of the cross member 110. A horizontal surface 160 of the notch 82 rests on a top surface 164 of the cross member 110. An inside face 166 of the cleat 80*c* rests against a vertical face 168 of the notch 124 in the chock member 116. Accordingly, the notch 124, the cross member 110, the chock member 116 and the runner 100 cooperate to define the socket 128 for receiving the lower notched end of the vertical cleats 80.

With reference to FIGS. 1 and 2, the finished wood reinforced corrugated paperboard body preferably knocks down into a flat condition for shipment. The additional scores 60 and 61 are provided in diagonally opposite corners of the set up body 14. These scores are a sufficient distance from the main panel scores 43 and 47, respectively, to allow the body 14 to fold around the corner vertical cleats 80*a* and 80*d*. The distance between the scores 60 and 43 and 61 and 47 is determined in a conventional manner by the thickness of the cleats 80 plus a standard scoring allowance. For typical one-inch thick cleats and medium test double wall corrugated paperboard, the distance is approximately one and three-eights inches.

The panels 42, 44, 46 and 48 of the blank 40 are sized in length and width to fit the dimensions of the tractor, or other equipment, to be packaged. The panels are scored in a conventional manner with industry standard allowances to fit easily, yet snugly, around the pallet 16. The score 51, 43, 45 and 47 form the normal body scores between the length and width panels 42, 44, 46 and 48 of the body 14. The depth of the panels is determined by the height dimension of the tractor plus the thickness of the pallet 16 and desired clearances between the hood or the highest point of the tractor to the innermost inside contact point at the top of the box. Normally, a one-and-a-half to two inch clearance is desired between the contents and the inside surface of the pack, but this may be reduced or increased by stacking requirements and truck and rail car inside height dimensions. The top flaps 52, 54, 56 and 58 are normally of an appropriate width so as to allow the edges of the flaps 54 and 58 to touch when the flaps are folded to close the body 14. The illustrated embodiment thus has a regular slotted carton style top common in box usage and manufacture. An alternate embodiment within the spirit and scope of the present invention provides a body with no flaps and an external top cap. In another alternate embodiment, the flaps are shortened and a corrugated sheet or pad is laid under the flaps to enclose and seal the top.

The overall dimensions of the pallet 16 include conventional clearances adequate to prevent abrasion of painted surfaces on the panels of the body 14 and to allow small movement in shipment to occur without such contact between the surfaces and the panel becoming a problem. Typically, such dimensions for garden tractors are approximately one and one-half inch in front of the nose of the tractor, one-half inch behind the rear wheels and one-half to three-quarters inch on each side.

The thickness and width of the cross members 110, 112 and 114 are dependent on the tractor weight and width. Also, if the pack is to be forkliftable, these cross members 110, 112 and 114 must have sufficient strength and thickness so as to not snap under the weight of the tractor mounted on the base. Preferably, the strength will permit a forklift operator to handle two or three units at a time by picking up the stack under the pallet 16 of the bottom unit. Thus, the cross members 110, 112 and 114 must be strong enough to withstand the fork pressure concentrated toward the center of the members with the load of the upper packs transferred through the pack cleats 80 to the bottom most pallet.

The thickness of the runners 100 and 102 is determined by the amount of clearance required for the fork blades. Different manufacturers have different requirements based on the length and thickness of the fork blades. A minimum is usually one and one-quarter inches and a maximum is approximately two inches. For clearances above two inches, blocks typically are added to the bottoms of the runners 100 and 102 to conserve weight and cost.

The middle cross member 108 preferably is located toward the center of gravity of the tractor and pallet 16 combination. It is positioned from the front end 95 of the pallet 16 an appropriate distance to catch the tips of the forklift blades. This provides a safe handling balance for the pack to reduce the possibility of the load tilting off of the fork blades. Often these packs are seventy inches or longer, and if the fork blades are short, for instances, thirty-six inches long, then placement of the cross member 108 is critical. Generally, fork blades of forty-eight and sixty inch lengths are normal.

In a preferred embodiment, the middle cross member 108 of the pallet 16 has a length less than the outside width between the runners 100. This provides an offset to receive the lower end of the center cleats 80*b* and 80*e*. Thus the center cleats 80*c* and 80*e* sit on the top surface of the runners 100 and against the edge of the middle cross member 108. This structure transmits the load to the upper surface of the cross member 108. Fork blade pressure from handling a plurality of packs with a fork truck will not cause the cross member 108 to separate from the runners 100 and 102. Thus the upper packs in a stack transmit their load through the cleats 80 to the top of the cross members 108 and 110 so that the forklift prongs will not pull the cross members 108 and 110 loose from the runners 100 and 102. A preferred embodiment clinch nails the middle cross member 108 to runners 100 and 102 to reduce separation of these components.

The notch 82 on the bottom of the cleats 80*b* and 80*e* is positioned against the edge of the cross member 108. This prevents the cleats 80*b* and 80*e* from being forced inward and into the tractor by clamp pressure where the operator does not position the platens low enough to contact the base runners 100. The notch 82 in the cleats 80*b* and 80*e* cooperate with the middle cross member 108 to provide pack rigidity. This prevents the corrugated body from ripping and the cleats 80*b* and 80*e* from being pushed inward by the clamp pressure.

An alternate embodiment includes a socket at the longitudinal ends of the middle cross member 108. Each of the sockets receives the lower end of one of the center vertical cleats 80. Each socket is defined by a notched U-shaped board mounted on the upper surface of the middle cross member 108. The notch is on the outside edge of the pallet. A portion of the upper surface is left uncovered by the notched U-shaped board. The U-shaped board hugs around three sides of the vertical cleat just above the notch 82 in the lower end of the cleat. The socket is thereby defined by the runner 100, the end of the middle cross member 108 and the U-shaped board.

The pack 10, as illustrated in FIG. 1, is assembled and packed at a manufacturers assembly line by first obtaining a knockdown wood cleated corrugated body 14 from a supply of such box bodies. The body 14 is positioned upside down and pulled open to a "squared-up" configuration. The pallet 16 is placed upside down into the bottom of the box where it mates with the vertical cleats 80. The notch 82 in the bottom of the corner cleats 80*a*, 80*c*, 80*d* and 80*f* nest in the corner sockets 128, as best illustrated in FIG. 4. The notch 82 in the bottom of the intermediate side cleats 80*b* and 80*e* rest on the runner 100 and the middle cross piece 108. The bottom flanges 62, 64 and 68 fold over against the bottom of the blocks 130 and the runners 100. Staples attach the bottom flanges 62, 64 and 68 to the wood blocks 130 and runners 100 in a conventional manner such as with an air operated staple gun common to the industry. Such staples are normally about one inch crown by one inch leg and are placed approximately every eight inches. In one embodiment, staple guide marks are preprinted on the flanges to aid the pack line crews in assembly.

The flanges 72, 74, 76 and 78 on the end panel 46 fold over onto the blocks 132 and the cross member 110 and secure as described above. In this fashion, the flanges 62, 64, 68, 72 and 78 fold under the pallet 16 and contact the floor when the pack is completed and positioned right side up. Because the block 132 does not extend the full distance between the runner 100 and the middle runner 102, the score lines 75 and 77 for the inner flaps 74 and 76 are displaced from the score lines 73 and 79 for the side flaps 72 and 78. The flanges 74 and 76 fold higher under the front end crossboard 110. The cutout 81 allows the flanges 74 and 76 to nest around the middle runner 102. This provides the cutout 134 through which the blades of a forklift truck pass easily beneath the pallet 16 between the wheels 122*a* of the tractor nested into the wheel wells 118.

The assembled body 14 and the pallet 16 are turned right side up. A hook assembly and hoist, usually electric for speed and ease of lifting, is connected to the frame of the tractor to be packaged, and the tractor is lifted and then lowered into the pack through the open top. The tractor is lowered onto the base 16 so that the wheels of the tractor drop into and are supported in the wheel wells 118 and 120 as illustrated in FIG. 3A. The chock block 121, the chock member 116 and the cross pieces 110, 112 and 114, cooperate with the bottom runners 100 and 102 to define the wheel wells 118 and 120 and effectively restrain the tractor from longitudinal and lateral movement about the base.

A parts box (not shown) containing various component parts customarily disassembled from the tractor is placed into the pack 10 in a suitable area. It is common in the industry to coat the external surface of such parts boxes with paraffin or a synthetic anti-abrasive chemical to prevent paint abrasion to the contents of the pack 10.

The top support pad 12 is positioned in the open top of the pack 10. First, the side flanges 22 and 24 and the end flange 26 fold along the score lines 28, 30 and 32, respectively. The flanges fold down at right angles to the sheet 20 as illustrated in FIG. 1. The cross support members 34 and 36 face downward toward the pack 10 and the contained tractor. The top support pad 12 is positioned in the upper end of the box with the support members 34 and 36 resting on the top of the cleats 80*a*, 80*b*, 80*e* and 80*f*. The upper ends of the cleats 80 define a plane along the boundary of or divide the corrugated box 14. The notch 39 in the longitudinal ends of both support members 34 and 36 mate with the upper beveled ends of the cleats. The vertical cleats 80*a* and 80*f* are positioned away from the scores 45 and 47, respectively, to allow for the thickness of the flange 26 of the top support pad 12 to insert between the cleats 80*a* and 80*f* and the end panel 46. This distance is approximately one-half inch but may vary depending on the flute and test of the paperboard used for the body 14 and the top pad 12. The support members 34 and 36 reinforce and support the coated, corrugated paperboard sheet 20. The support members 34 and 36 can be varied in thickness and width to suit the specific stacking and handling requirements of the product to be packaged. In addition, the support members 34 and 36 provide stiffness and resistance to the pressure of the platens of a clamp truck when the package is handled. Preferably, the support member 36 is positioned in front and above the hood of the tractor so that the support member 36 will not damage, crease or abrade the hood should the tractor bounce into the support pad 12 during shipment. The longitudinal length of the pad 20 is determined by the length of the tractor hood so that the support member 34 is positioned away from the edge of the hood and toward the middle of the pack. Generally, the support member 34 is positioned between the steering column and the edge of the hood.

The end flange 26 provides an additional nose or front end cushion to the upper frontmost or nose area of the tractor hood. The cushion protects against damage or paint abrasion to this area of the hood should the package receive an external blow, such as, being rammed by the mast of a forklift or clamp truck during handling. The length of the flange 26 is determined by the point at which the nose or grill of the tractor is furthest forward. The design or styling on some models position this point lower on the grill. In this case, the flange 26 would be made long enough to pass below the point to provide the desired cushioning effect.

The flanges 22, 24 and 26 are folded at right angles to the surface of the sheet 20. The body walls 44, 46 and 48 receive the side surfaces of the flanges upon insertion of the top support pad 12 into the open box. The flanges positioned at right angles stiffen the pad 12 to resist bowing under a top load. The stiffness attained at the point at which a right angle is formed in a planar surface depends to some degree on the depth of the flange legs 22, 24, 26 but the inherent strength is determined by the properties of the material, tear resistance and the like. In a preferred embodiment, the flanges 22, 24, 26 have a depth of about five inches.

The top flap 52 with its support board 86 folds down onto the vertical corner cleats 80*c* and 80*d*. The notch 90 in the ends matingly engages the bevel 84 in the vertical cleats 80*c* and 80*d*. The support board 86 thus cooperates with the top pad 12 and its support members 34 and 36, to reinforce the top of the pack 10 and distribute the top load to the pallet 16. This capability to carry and distribute the top load allows for imperfect stacking and movement of the stacked containers in transit.

The mating notched bevel 84 of the cleats 80 forces a tighter fit under top loading pressure to assure that the cross support members 34 and 36 are not displaced and forced off of the vertical cleats supporting the top support pad 12. The angle of the bevel is preferably between eighteen and twenty-four degrees, but can vary from about five to about thirty degrees or more. The steeper the angle, the deeper the bevel notch 39 and 89 must be in the cross support members 34, 36 and 86, respectively. Too shallow of an angle will not provide the desired interlocking affect.

The distance between the top end of the cleats 80 and the top flap scores 53, 55, 57 and 59 is determined by the depth of the notches 39 and 89 in the support members 34, 36 and 86, plus the thickness of the corrugated paperboard on the top pad 12, and the standard folding allowances as conventionally determined by the test and flute structure of the corrugated paperboard for the body 14. The depth of the notch 82 in the bottom of the cleats 80 is approximately equal to the thickness of the cross members 110. The thickness of the lower notch leg is generally equally to the width of the gap 122. In a preferred embodiment, this gap is approximately one-half the overall thickness of the cleat 80. The off-set from the bottom of the cleat 80 to the flange scores 65 and 69 is determined by the thickness of the pallet runners 100 plus standard scoring allowances which depend on the test and flute structure of the corrugated paperboard for the body 14. This allows for relatively easy but snug folding of the lower flanges under the pallet 16 for a resultant tight closure of the pallet 16 onto the vertical box cleats 80 when the pallet 16 and the body 14 are assembled.

In an alternate embodiment, a coating of glue is applied to the outside (upper) surface 20 of the top support pad 12. Conventionally, this is accomplished by the use of an "air-spray" glue head which sprays glue under air pressure, although roller type applicators work as well. The glue may also be applied to the exposed surface of the flap 56 before folding over against the surface 20 of the top support pad 12. The side flaps 54 and 58 are fold over on top of the end flap 56 and the top support pad 12 and secure to the cross members 32, 34 and 86 using staples as described above. Staple marks are commonly pre-printed to aid the pack line crew in proper placement of the staples so that the staples penetrate all corrugated surfaces and imbed themselves into the rigid cross boards.

Application of glue to both the upper surface of the top support pad 12 and the flap 56 enhances pack performance. Two surfaces in contact and loaded perpendicular to the plane of the surfaces have greater resistance and load bearing capabilities when such surfaces are bonded or laminated together instead of merely resting adjacent one another. When merely resting on one another, the two surfaces will act independently of each other when under load, with the first scoring or cracking and then forcing the lower surface to do the same. If the two surfaces are laminated together, slippage between their common surfaces cannot occur and the two components act as a single member. The present invention accordingly provides a laminated, unitary corrugated paperboard protective cover over the vulnerable sheet metal or fiberglass hood of a tractor during packing, storing and handling.

The top pad support 12 of the present invention afford greater hood protection than was afforded by the old style wooden top frame in which the wood cross piece was positioned over the hood. The unitary-homogeneous nature of the resultant laminated paperboard structure covering the full width of the pack and covering the entire hood area of the tractor is less likely to yield under concentrated center load than is a board used with the old style top frame. The consistency and the pliability of the laminated structure of the present invention provides superior performance over typical crating-grade lumber. First, such a laminated structure is less likely to yield under concentrated center load than is a board used on wood top frames. Second, defective boards are not easily culled at the box manufacturer's plant. Some defects, such as excessive slope of grain or fiber defects, are almost undetectable. Defects permit the frame to fail under load. The top pad support 12 maintains adequate protection for a tractor even if such breaking of the cross support members 34 and 36 occurs. The structural strength of the pack 10 may be lessened however. Third, the entire length of the rigid cross member 34 and 36 is glued to the support sheet 20.

The cross members 34 and 36 are preferably disposed and glued along lines perpendicular to the corrugations of the top sheet 20. The top pad 14 then better resists creasing and collapse along a corrugation because of heavy objects placed or falling on top of the pack 10.

Further, a preferred embodiment includes an anti-abrasive coating (such as paraffin or specialty chemicals) applied to the underside 37 of the top support pad 12. This coating provides additional protection to the hood of the tractor. For instances, the air in the tire tractors permit the tractors to bound up and down during transit over rough roads or during rough handling. Cross pieces on a wood top frame may dent or crease the hood of a tractor as it bounces up and down inside the package during long trips or rough handling. The top support pad 12 of the present invention has a large coated surface with no sharp or abrupt edges over the hood. This reduces the opportunity for hood damage while providing significant overall strength over the hood to prevent damage which might occur from a top load incident, such as another package falling on top of the container.

The principles, preferred embodiments, and modes of operation of the present invention have been described in the foregoing specification. The invention is not to be construed as limited to the particular forms disclosed because these are regarded as illustrative, rather than restrictive. Moreover, variations and changes may be made by those skilled in the art without departing from the spirit of the invention as described by the following claims.

What is claimed is:

1. A wood reinforced corrugated container, comprising:

a pallet for supporting an article to be packed;

a corrugated paperboard body which attaches at a bottom end to the pallet, comprising a blank of corrugated paperboard scored for folding to provide a two opposing side walls and two opposing end walls, a plurality of vertically disposed spaced apart cleats attached to the two side walls, and a plurality of top flaps each joined along a respective second score line to a separate one of the walls and foldable normal to the wall to close the container;

a first rigid member disposed normal between the side walls and supported at its longitudinal ends by one of the cleats on each of the side walls;

a second rigid member disposed normal between the side walls and supported at its longitudinal ends by one of the other cleats on each of the side walls; and a sheet of semi-rigid material attached to an upper surface of each of the first and second rigid members;

a third rigid member attached to the top flap of one of the end walls and disposed parallel to the respective second score line, wherein the longitudinal ends of the third rigid member contacts one of the other cleats on each of the side walls for support when the top flap is folded to partially close the container.

2. The wood reinforced corrugated container as recited in claim 1, wherein the sheet has a coated surface for facing an article packed in the container.

3. A protective member, sized for inserting into an open end of a wood reinforced corrugated paperboard container comprising a blank of corrugated paperboard scored for folding to provide a pair of side walls and a pair of end walls, at least one pair of vertically disposed end cleats with one end cleat attached to each of the side walls and both adjacent the same end wall, and a pair of vertically disposed middle cleats with one middle cleat attached to each of the side walls between the end walls, comprising:

a planar sheet having four sides;

a pair of side flanges, one side flange extending outwardly from each of two opposing sides of the sheet;

an end flange extending outwardly from a third side of the sheet;

each of the side flanges and the end flange foldable along a respective score line to a position normal to the sheet, with no flange on a fourth side of the sheet;

a first support member attached to a lower surface of the sheet parallel to and near the score line for the end flange and extending between the two opposing sides for supporting by an upper end of each of the end cleats; and a second support member attached to the lower surface of the sheet parallel to and spaced apart from the first support member and extending between the two opposing sides for supporting by an upper end of each of the middle cleats, wherein the article in the container is protected by inserting the sheet, with the side flanges and the end flanges folded normal to the sheet, into the open end of the container to bring the first and the second support members into contact with the respective end and middle cleats thereby partially closing the container.

4. The protective member as recited in claim 3, wherein the sheet is made of corrugated paperboard.

5. The protective member as recited in claim 4, wherein the corrugations of the sheet are normal to the support members.

6. The protective member as recited in claim 3, wherein the end flange extends outwardly from the sheet a greater distance than the side flanges.

7. The protective member as recited in claim 3, wherein an edge of the side flange is spaced apart from the end flange at least a distance equal to a width of the first support member, whereby a gap is defined between the side flange and the end flange when folded normal to the sheet.

8. A wood reinforced corrugated paperboard container, comprising:

a pallet for supporting an article in the container;

a paperboard body which attaches at a bottom end to the pallet, comprising a blank of corrugated paperboard scored for folding to provide a pair of side walls and a pair of end walls, two vertically disposed end cleats, one end cleat attached to each of the side walls adjacent the same end wall, and a vertically disposed middle cleat attached to each of the side walls between the end walls;

a planar sheet sized for inserting into an open end of the corrugated paperboard body and including:

a side flange extending outwardly from each of two opposing sides of the sheet;

an end flange extending outwardly from a third side of the sheet;

each of the side flanges and the end flange foldable along a respective score line to a position normal to the sheet for disposing firmly against a respective wall of the paperboard body with no flange on a fourth side of the sheet;

a first support member attached to a lower surface of the sheet parallel to and near the score line for the end flange and extending between the two opposing edges of the sheet for supporting by an upper end of each of the end cleats adjacent one of the end walls; and a second support member attached to the lower surface of the sheet parallel to and spaced apart from the first support member and extending between the two opposing edges of the sheet for supporting by an upper end of each of the middle cleats, whereby the article in the container is protected by inserting the sheet, with the side flanges and the end flanges folded normal to the sheet, into the open end of the container to bring the support members into contact with the respective end and middle cleats.

* * * * *